US008965031B2

(12) United States Patent
Shinyama et al.

(10) Patent No.: US 8,965,031 B2
(45) Date of Patent: Feb. 24, 2015

(54) EARPHONE WITH ELASTIC HOLDER FOR DRIVER AND CORD

(71) Applicant: Molex Incorporated, Lisle, IL (US)

(72) Inventors: Makoto Shinyama, Yamato (JP); Tomonari Kaneko, Ebina (JP); Kotaro Kamada, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/852,448

(22) Filed: Mar. 28, 2013

(65) Prior Publication Data

US 2013/0259288 A1 Oct. 3, 2013

(30) Foreign Application Priority Data

Mar. 30, 2012 (JE) ..... 2012-080998

(51) Int. Cl.
*H04R 1/10* (2006.01)
*H04R 31/00* (2006.01)
*H04R 29/00* (2006.01)

(52) U.S. Cl.
CPC ..... *H04R 1/1033* (2013.01); *H04R 1/1016* (2013.01); *H04R 31/00* (2013.01); *H04R 29/001* (2013.01)
USPC ..... 381/380; 381/384

(58) Field of Classification Search
CPC .. H04R 1/1033; H04R 1/1058; H04R 1/1066; H04R 1/1075; H04R 25/65; H04R 25/658; H04R 1/1016
USPC ..... 381/370, 374, 380, 384
See application file for complete search history.

(56) References Cited

U.S. PATENT DOCUMENTS 8,594,359 B2 11/2013 Takei
2011/0158457 A1* 6/2011 Ishizaka ..... 381/380
2011/0317864 A1* 12/2011 Kaneko et al. ..... 381/380

FOREIGN PATENT DOCUMENTS

JP 2008-109206 5/2008

OTHER PUBLICATIONS

Machine Translation of Japanese Patent 2008-109206; Aug. 5, 2008, Masuda et al.*

* cited by examiner

*Primary Examiner* — Ahmad F Matar
*Assistant Examiner* — Katherine Faley
(74) *Attorney, Agent, or Firm* — Timothy M. Morella

(57) ABSTRACT

The earphone of the Present Disclosure includes a driver for converting electric signals into sound waves, a cord connected to the driver, an elastic holder, a housing and an earpiece. The elastic holder integrally possesses a cylindrical driver housing portion for inserting the driver, and a cord housing portion for housing the end portion of the cord. The housing possesses a cylindrical main body for inserting at least the driver housing portion of the elastic holder, and a sound conduit provided in the end portion of the main body. The earpiece is fitted into the ear canal.

14 Claims, 9 Drawing Sheets

EARPHONE WITH ELASTIC HOLDER FOR DRIVER AND CORD

REFERENCE TO RELATED APPLICATIONS

The Present Disclosure claims priority to prior-filed Japanese Patent Application No. 2012-080998, entitled "Earphone And Manufacturing Method Therefor," filed on 30 Mar. 2012 with the Japanese Patent Office. The content of the aforementioned Patent Application is incorporated in its entirety herein.

BACKGROUND OF THE PRESENT DISCLOSURE

The Present Disclosure relates generally to an earphone, and, more particularly, to an earphone inserted into the ear canal.

In a conventional earphone, the earpiece and the sound conduit in the housing are inserted into the ear canal. An example is disclosed in Japanese Patent Application No. 2006-287726, the content of which is incorporated by reference in its entirety herein.

The earphone 10 disclosed in the '726 Application has receiver body 18, a gasket 22 holding the receiver body 18, a cord 24, a cord pull-out member 30 holding the cord 24, a housing body 26, and an earpiece 14 attached to the housing body 26. In the manufacturing process for this earphone 10, the receiver body 18 and the gasket 22 are inserted into the housing body 26, the cord 24 is connected to the receiver body 18 while the cord 24 is being held by the cord pull-out member 30, and the housing body 26 and the cord pull-out member 30 are fitted together. However, conventional earphones like that disclosed have a relatively large number of components and are difficult to manufacture.

SUMMARY OF THE PRESENT DISCLOSURE

In view of this situation, the main purpose of the Present Disclosure is to provide an earphone and a manufacturing method for this earphone able to reduce the number of components. Accordingly, the earphone of the Present Disclosure includes a driver for converting electric signals into sound waves, a cord connected to the driver, an elastic holder, a housing, and an earpiece. The elastic holder is made of an elastic material, and integrally possesses a cylindrical driver housing portion for inserting the driver and a cord housing portion for housing the end portion of the cord. The housing possesses a cylindrical main body for inserting at least the driver housing portion of the elastic holder and a sound conduit provided in the end portion of the main body. The earpiece is fitted into the ear canal to direct sound waves from the sound conduit into the ear canal. The earpiece fitted into the ear canal may be made of an elastic material, and may be shaped so as to be easily inserted into the ear canal. In the Present Disclosure, the driver-holding function and the cord-holding function are both based in the elastic holder. This reduces the number of components.

In the earphone 10 disclosed in the '726 Application, the receiver body 18 is held by a gasket 22, and the cord 24 is held by a cord pull-out member 30. However, in the Present Disclosure, driver-holding function and the cord-holding function are both based in the elastic holder, allowing the number of components to be reduced.

In one aspect of the Present Disclosure, the cord housing portion has a wall portion continuous with the driver housing portion and an extended portion extending from the outer face of the wall portion. An insertion hole is also formed from the wall portion to the extended portion for insertion of the cord. In this way, the cord can be extended in the direction of extension of the extended portion from the outer face of the wall portion.

In another aspect of the Present Disclosure, the ring-shaped end portion of the driver housing portion is arranged so as to surround the opening in the sound conduit provided in the end portion of the main body of the housing. In this way, the space formed between the driver and the sound conduit is sealed, and the acoustic properties are improved.

In another aspect of the Present Disclosure, a rib is formed in an outer peripheral face of the driver housing portion and extends peripherally so as to contact an inner peripheral face of the housing, and a rib is formed in an inner peripheral face of the driver housing portion and extends peripherally so as to contact an outer face of the driver. Here, the rib on the outer peripheral face and the rib on the inner peripheral face are staggered with respect to each other in the axial direction of the driver housing portion. By providing ribs on both the inner peripheral face and the outer peripheral face, the space formed between the driver and the sound conduit is sealed, and the acoustic properties are improved. By staggering the rib on the outer peripheral face and the rib on the inner peripheral face with respect to each other in the axial direction of the driver housing portion, the locations at which the driver housing portion is elastically deformed can be distributed in the axial direction.

In another aspect of the Present Disclosure, a slit is formed in the driver housing portion enabling the driver connected to the cord to be inserted from the outside to the inside. In this way, the driver can be inserted into the driver housing portion after the cord has been connected to the driver outside of the driver housing portion. This improves operational efficiency.

In another aspect of the Present Disclosure, the earphone also includes an inner ring member attached to the cord housing portion and inserted between the cord housing portion and main body of the housing. Here, the inner ring member has an engaging portion for engaging an engaging portion formed on an inner peripheral face of the main body of the housing. Because the rigidity can be increased near the cord housing portion by attaching an inner ring member, the elastic holder can be more easily inserted into the housing. Also, the engaging portion of the inner ring member can be used to secure the elastic holder in the housing.

In another aspect of the Present Disclosure, the inner ring member has a ring-shaped portion formed in the engaging portion and is partially cutaway in the circumferential direction so as to enable elastic deformation in the radial direction. In this way, the elastic deformation of the ring-shaped portion can be used to more securely engage the housing and inner ring member.

In another aspect of the Present Disclosure, the cord housing portion has a blocking portion for blocking the opening in the main body of the housing, and the inner ring member has an extended portion extending from the ring-shaped portion in the axial direction and contacting the blocking portion. Because contact between the extended portion and the blocking portion transmits the insertion pressure applied to the blocking portion from the blocking portion to the extended portion, the elastic holder can be more easily inserted into the housing.

In another aspect of the Present Disclosure, the cord housing portion has a blocking portion for blocking the opening in the main body of the housing, and the inner ring member is fitted into a recessed portion formed between the driver housing portion and the blocking portion. By fitting the inner ring member into the recessed portion, the insertion pressure applied to the blocking portion can be transmitted from the blocking portion to the driver housing portion via the inner ring member. As a result, the elastic holder can be more easily inserted into the housing.

In the manufacturing method for an earphone according to the Present Disclosure, an assembly including the driver, the cord, and the elastic holder is formed by inserting the driver into the driver housing portion, and by connecting the cord to the driver so that the end portion of the cord is held by the cord housing portion, and so that at least the driver housing portion of the assembly is inserted into the main body of the housing. Because an assembly is formed in the Present Disclosure in which the cord is connected to the driver, the assembly can be tested for faults before the final product is formed.

In the manufacturing process for the earphone 10 in the '726 Application, a first assembly is created in which the receiver body 18 and the gasket 22 are inserted into the housing body 26, and a separate second assembly is created in which the cord 24 is held by the cord pull-out member 30. The cord 24 in the second assembly is connected to the receiver body 18 in the first assembly, and the housing body 26 in the first assembly is then fitted to the cord pull-out member 30 of the second assembly. Because a plurality of separate assemblies are not formed in the Present Disclosure, the manufacturing process is simpler than that of the '726 Application.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
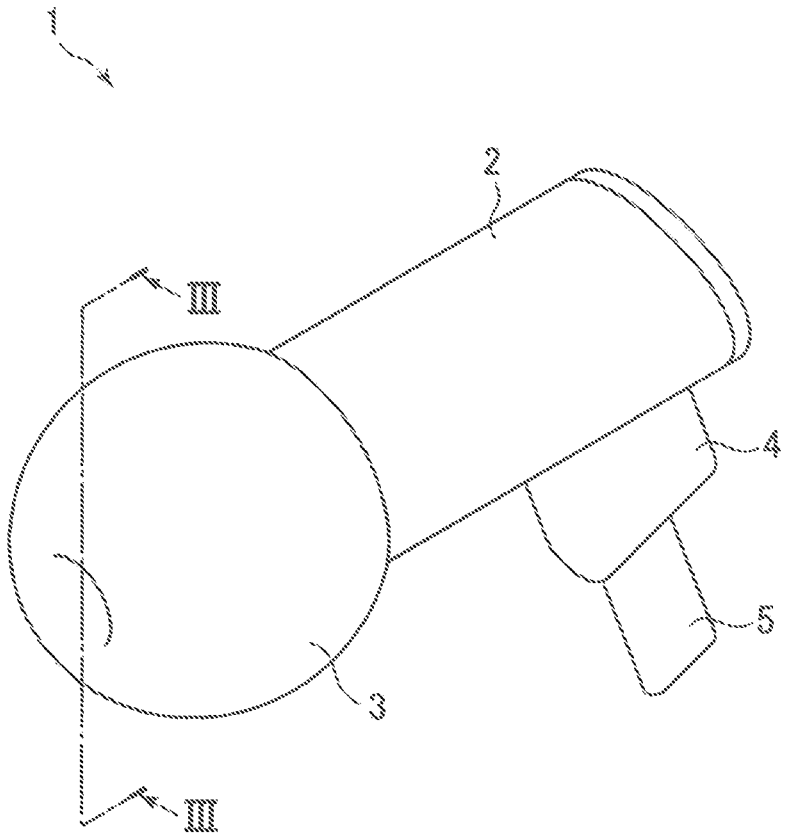
FIG. 1 is a perspective view of an earphone according to an embodiment of the Present Disclosure.
Figure 2:
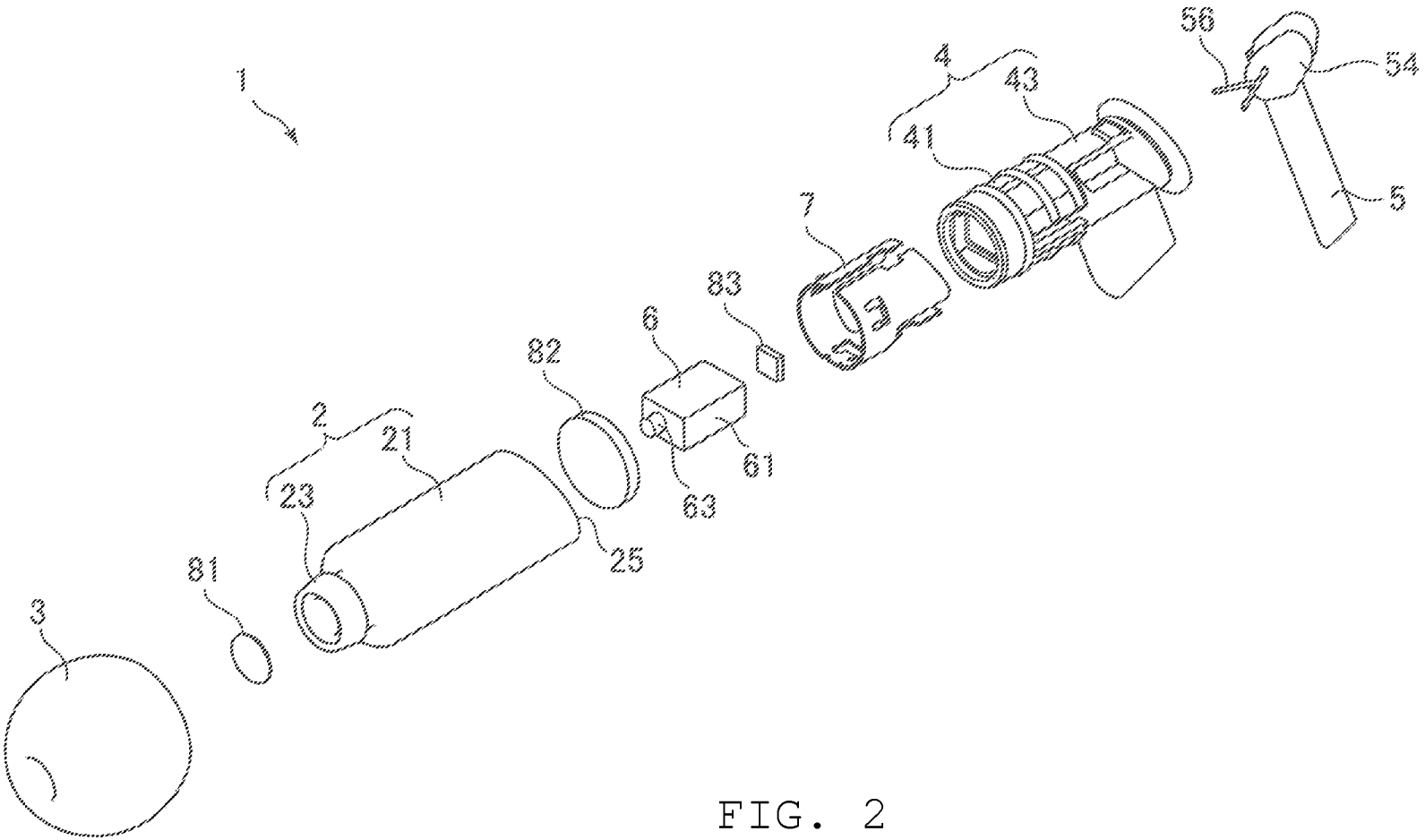
FIG. 2 is an exploded perspective view of the earphone of FIG. 1.
Figure 3:
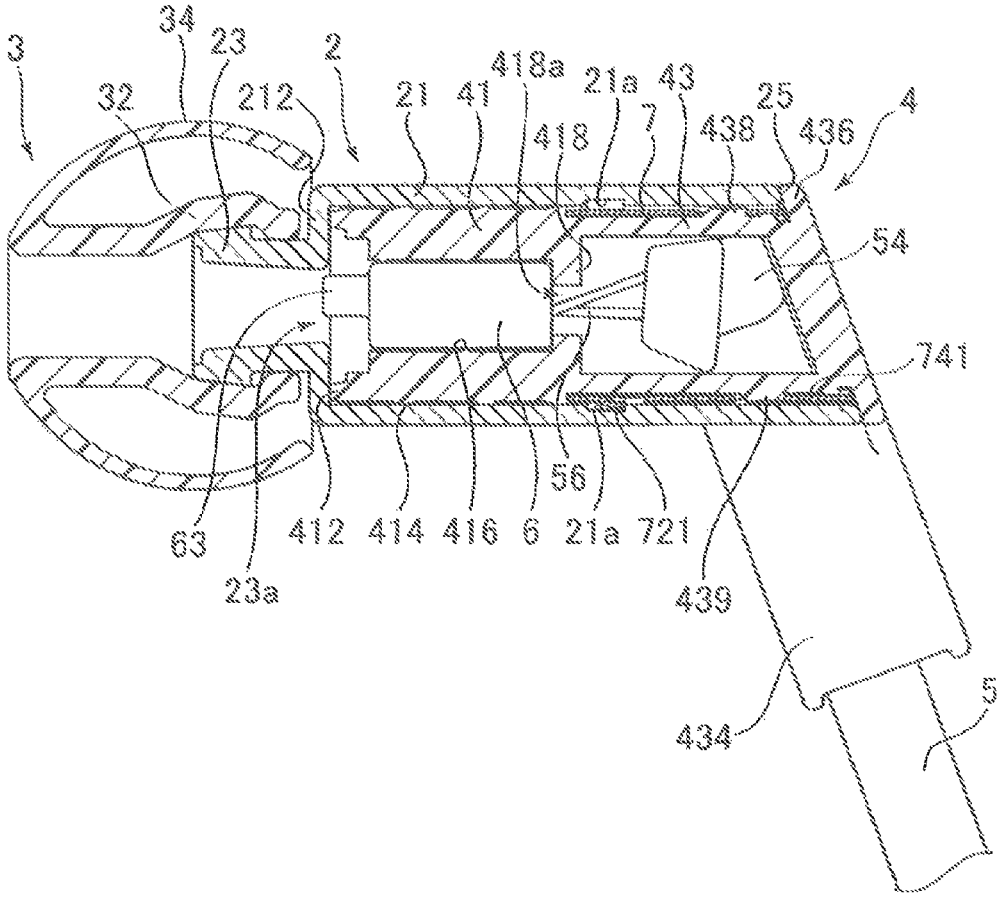
FIG. 3 is a cross-sectional view of the earphone of FIG. 1.

Referring to FIGS. 1-3, the earpiece 3 is positioned in front of the housing 2, and the cord 5 is positioned below the housing 2. When the cord 5 is positioned below and towards the front, the left hand is to the left and the right hand is to the right. The earphone 1 has a substantially cylindrical housing 2, an earpiece 3 positioned in front of the housing 2, an elastic holder 4 inserted into the housing 2, a flat cord 5 held by the elastic holder 4 and extending downward to the rear, and a driver 6 held by the elastic holder 4 and housed inside the housing 2. The earphone 1 also has an inner ring member 7 attached to the elastic holder 4 and inserted into the housing 2. The housing 2 is made of a metal, and has a cylindrical main body 21, and a sound conduit 23 with a diameter smaller than that of the main body 21 provided on the front end of the main body 21. An opening is formed in the rear end of the main body 21 for inserting the elastic holder 4, and the edge portion 25 of the opening is inclined downward and to the rear, which is the same as the direction of extension for the cord 5. The housing 2 may be a molded component made of a synthetic resin material.

The earpiece 3 is made of an elastic material, and has a cylindrical portion 32 attached to the sound conduit 23 of the housing 2, and a flange 34 increasing in width parabolically towards the rear from the front end of the cylindrical portion 32. The Present Disclosure is not limited to this embodiment. For example, the earpiece may be integrated with the housing 2 to extend the sound conduit 23 of the housing 2, and this may be inserted directly into the ear canal.

The elastic holder 4 is made of an elastic material or an elastomer, and has a driver housing portion 41 for housing the driver 6, and a cord housing portion 43 for housing the end portion 54 of the cord 5. The elastic holder 4 is explained below in greater detail.

The cord 5 contains wires for supplying electrical signals to the driver 6. Here, electrical wires 56 are coated with a resin such as a vinyl resin. This cord 5 has an end portion 54 having a portion formed as a knob to be housed in the knob housing portion 43 of the elastic holder 4, and a plurality of electrical wires 56 extending from the end portion 54. These electrical wires 56 are stripped of the coating on the cord 5, and soldered to terminals (not shown) provided on the rear face of the driver 6.

The driver 6 is a component for converting electric signals supplied by the cord 5 into sound waves, and has a cubical main body 61, and a cylindrical protruding portion 63 provided on the front face of the main body 61 and facing forward for generating sound waves. In the present embodiment, the driver 6 is a balanced armature-type driver. However, the driver 6 may also be another type of driver such as a dynamic driver.

The inner ring member 7 is made of a metal, and is attached to the cord housing portion 43 of the elastic holder 4 and inserted between the cord housing portion 43 and the main body 21 of the housing 2. The inner ring member 7 may be a molded component made of a synthetic resin material. The inner ring member 7 will be explained below in greater detail.

In addition to these components, the earphone 1 may also include a dust filter 81 such as a sponge made of non-woven cloth or a synthetic resin material, and equalizers 82, 83. These components have been removed from the cross-sectional view in FIG. 3. The dust filter 81 is fitted to the end portion of the sound conduit 23, and the equalizers 82, 83 are arranged in front and back of the driver 6. One of the equalizers 82 can function as the dust filter 81 when the dust filter 81 has been removed.

Figure 4A:
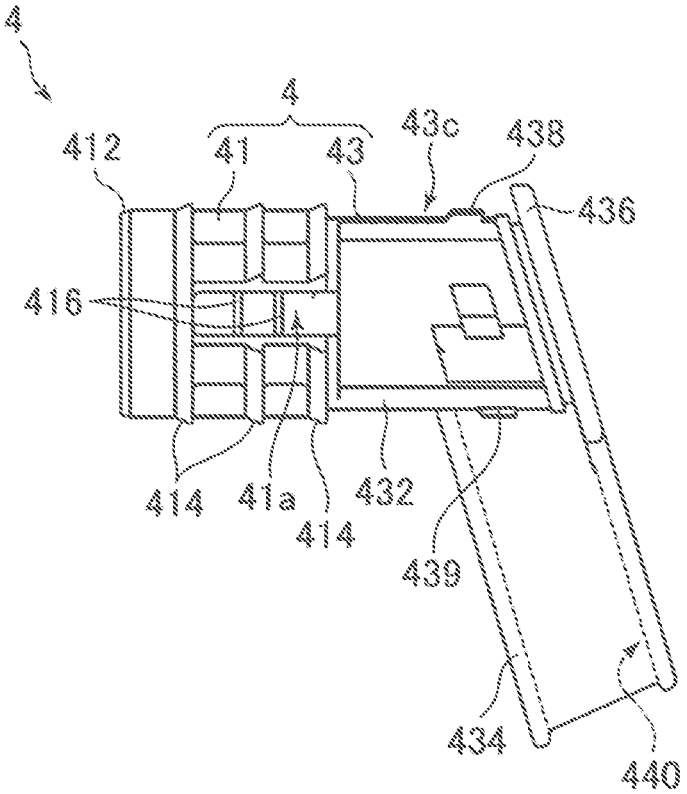
FIG. 4A is a side view of an elastic holder included in the earphone of FIG. 1.
Figure 4B:
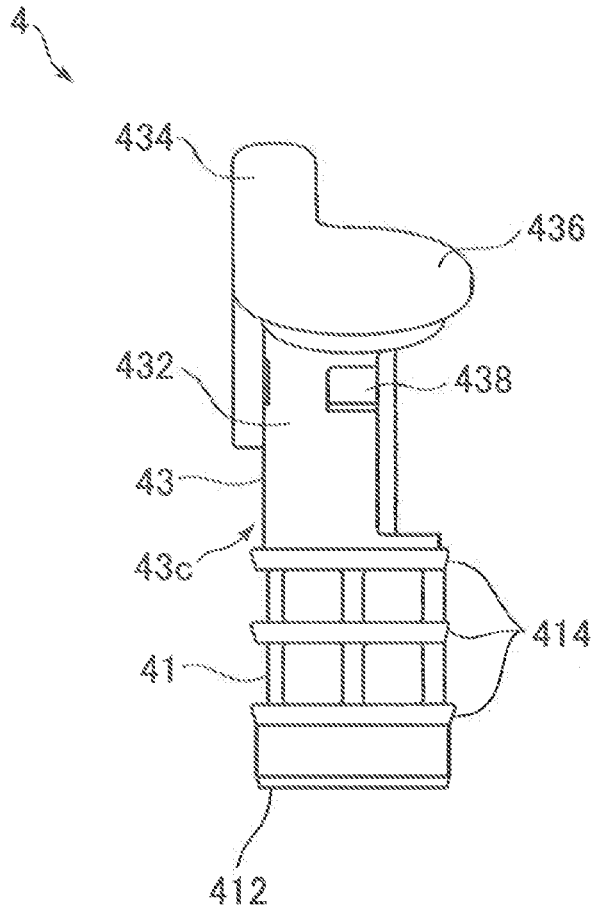
FIG. 4B is a front view of the elastic holder of FIG. 4A.

Referring to FIGS. 3-4B, the front half of the elastic holder 4 is configured as the driver housing portion 41 for housing the driver 6. The driver housing portion 41 is formed in the shape of a cylinder, and the driver 6 is inserted inside. More specifically, the driver housing portion 41 has a cylindrical outer peripheral face, and an inner peripheral face with a rectangular cross-sectional profile that conforms to the rectangular outer peripheral face of the driver 6.

A plurality of protruding outer peripheral ribs 414 extending over the entire circumference are formed on the outer peripheral face of the driver housing portion 41. Also, a plurality of protruding inner peripheral ribs 416 extending over the entire circumference area formed on the inner peripheral face of the driver housing portion 41.

A ring-shaped end portion 412 is formed in the front end of the driver housing portion 41 and is thicker in the forward direction. Also, a partitioning wall 418 with a central opening is formed in the rear end of the driver housing portion 41 (see FIG. 3).

A slit 41*a* open to the rear is formed in a side portion of the driver housing portion 41. This slit 41*a* is formed on the side without the semi-cylindrical portion 432 of the cord housing portion 43 relative to the center line of the driver housing portion 41 (the left side in FIG. 4A). The use of the slit 41*a* will be explained below in detail.

As shown in FIG. 3, when the driver housing portion 41 is inserted into the main body 21 of the housing 2, the ring-shaped end portion 412 of the driver housing portion 41 makes contact in a compressed state with the front end wall 212 of the main body 21 of the housing 2 so as to surround the opening 23*a* in the sound conduit 23 formed in the end wall 212. This improves the airtight seal of the space formed between the driver 6 and the sound conduit 23, and directs the sound waves generated by the driver 6 into the sound conduit 23 without any leakage to the rear.

When the equalizer 82 has been arranged (see FIG. 2), the ring-shaped end portion 412 of the driver housing portion 41 is pinched between the equalizer 82 and the front end wall 212 of the main body 21 of the housing 2. This also improves the airtight seal of the space formed between the driver 6 and the sound conduit 23.

When the outer diameter of the outer peripheral ribs 414 formed on the outer peripheral face of the driver housing portion 41 is greater than the inner diameter of the inner peripheral face of the main body 21 of the housing 2, and the driver housing portion 41 is inserted into the main body 21 of the housing 2, the outer peripheral ribs 414 contact the inner peripheral face of the main body 21 of the housing 2 in a compressed state. This also improves the airtight seal of the space formed between the driver 6 and the sound conduit 23.

When the rectangular dimensions of the inner peripheral ribs 416 formed on the inner peripheral face of the driver housing portion 41 are smaller than the rectangular dimensions of the outer peripheral face of the driver 6, and the driver 6 is inserted into the driver housing portion 41, the inner peripheral ribs 416 come into contact with the outer peripheral face of the driver 6 in a compressed state. This also improves the airtight seal of the space formed between the driver 6 and the sound conduit 23.

When the driver 6 is inserted into the driver housing portion 41, the rear face of the driver 6 contacts the partitioning wall 418 of the driver housing portion 41. The electrical wires 56 in the cord 5 are connected to the rear face of the driver 6 via the opening 418*a* formed in the partitioning wall 418. When the equalizer 83 is arranged (see FIG. 2), the equalizer 83 is arranged inside the opening 418*a* in the partitioning wall 418.

In the present embodiment, as explained above, the airtight seal of the space formed between the driver 6 and the sound conduit 23 is improved by the ring-shaped end portion 412, the outer peripheral ribs 414, and the inner peripheral ribs 416 of the driver housing portion 41 made of an elastic material and the sound waves generated by the driver 6 are directed to the sound conduit 23 without leakage to the rear. As a result, this improves acoustic performance. By improving the airtight seal in this way, the amount of adhesive used between the main body 21 of the housing 2, the driver housing portion 41, and the housing 6 can be reduced or eliminated. Because the driver 6 is inserted into a driver housing portion 41 made of an elastic material, the driver 6 is less likely to become damaged or deteriorate due to the impact.

Returning to FIGS. 4A-4B, the rear half of the elastic holder 4 serves as the cord housing portion 43 for housing the end portion 54 of the cord 5. The cord housing portion 43 includes a semi-cylindrical portion 432 or wall portion continuous with the driver housing portion 41, a hollow panel-like extended portion 434 extending downward and to the rear from the semi-cylindrical portion 432, and a disk-shaped blocking portion 436 provided in the rear end of the semi-cylindrical portion 432.

A semi-cylindrical portion 432 is formed along the center line of the driver housing portion 41 and is open on both the left and the right ends (the left is shown in FIGS. 4A-B). The semi-cylindrical portion 432 has a diameter that is somewhat smaller than that of the driver housing portion 41, and the outer peripheral face of the semi-cylindrical portion 432 has a recessed portion 43*c* between the driver housing portion 41 and the blocking portion 436. A protruding portion 438, 439 is formed, respectively, in the upper end and the lower end of the outer peripheral face of the semi-cylindrical portion 432.

An extended portion 434 is positioned and skewed on the side with the semi-cylindrical portion 432 relative to the center line of the semi-cylindrical portion 432 (to the right in FIGS. 4A-B). A cord insertion hole 440 connected to the inside of the semi-cylindrical portion 432 is formed in the extended portion 434 (indicated by the dotted lines in FIG. 4A). The blocking portion 436 has a diameter greater than that of the semi-cylindrical portion 432, and slopes downward to the rear to cover the edge portion 25 of the opening formed in the rear end when the elastic holder 4 has been inserted into the housing 2.

As shown in FIG. 3, the semi-cylindrical portion 432 of the cord housing portion 43 is inserted along with the inner ring member 7 into the main body 21 of the housing 2. The cord 5 has an end portion 54 having a portion formed as a knob to be housed in the semi-cylindrical portion 432, the electrical wires 56 extending from the end portion 54 are connected to the driver 6 inserted into the driver housing portion 41. The cord 5 is inserted into the cord insertion hole 440 in the extended portion 434, and extends from the lower end. The knob of the cord 5 engages the edge of the insertion hole 440 on the inside of the semi-cylindrical portion 432, and this keeps the cord 5 from being damaged when pulled out too vigorously. Because the extended portion 434 is made of an elastic material, it does not damage the cord 5 when bent. The blocking portion 436 of the cord housing portion 43 pushes forward when the elastic holder 4 is inserted into the main body 21 of the housing 2, and eventually blocks the opening formed in the rear end of the main body 21.

FIGS. 5A-D are a side view, top view, front view and bottom view of the inner ring member 7. The inner ring member 7 is substantially cylindrical, and a slit 7*a* is formed in the upper end in the axial direction. The front half of the inner ring member 7 serves as the ring-shaped portion 72 and is elastically deformable in the radial direction because of the slit 7*a*. A plurality of claw portions 721-723 protruding outward are formed in the ring-shaped portion 72 to serve as the engaging portion.

A plurality of extended portions 741-743 are provided in the rear half of the inner ring member 7 which extend in the axial direction from the ring-shaped portion 72. A hole 74*a* is formed in the lower extended portion 741. When the slit 7*a* is positioned between the left and right extended portions 742, 743, there is a wide portion 74*b* in the middle in which the width of the slit 7*a* is expanded. The rear ends of the extended portions 741-743 slope downward to the rear in the same manner as the blocking portion 436.

Figure 7:
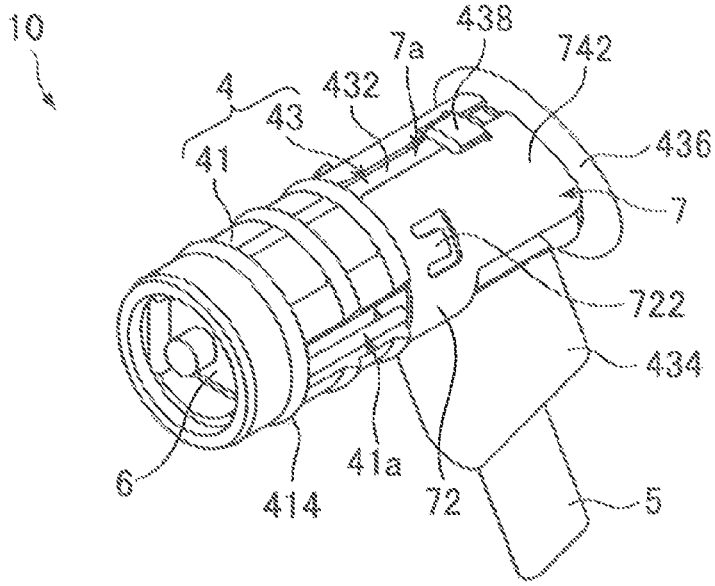
FIG. 7 is another diagram used to explain the manufacturing process for the earphone of FIG. 1.

As shown in FIGS. 3 and 7, the inner ring member 7 is attached to the semi-cylindrical portion 432 of the cord housing portion 43. The inner ring member 7 is fitted into the recessed portion 43*c* formed between the driver housing portion 41 and the blocking portion 436 (see FIG. 4A), and the outer peripheral face of the semi-cylindrical portion 432 contacts the inner peripheral face of the ring-shaped portion 72. Also, the front end of the ring-shaped portion 72 contacts the driver housing portion 41, and the rear ends of the extended portions 741-743 contact the blocking portion 436. The protruding portion 438 formed on the upper end of the semi-cylindrical portion 432 is fitted into the wide portion 74*b* formed between the left and right extended portions 742, 743, and the protruding portion 439 formed on the lower end of the semi-cylindrical portion 432 is fitted into the hole 74*a* formed in the lower extended portion 741.

The inner ring member 7 fitted on the semi-cylindrical portion 432 of the cord housing portion 43 which, in this manner, is inserted into the main body 21 of the housing 2 along with the semi-cylindrical portion 432, while being compressed in the radial direction. By fitting the inner ring member 7 on the semi-cylindrical portion 432 of the cord housing portion 43, the rigidity of the rear half of the elastic holder 4 is increased, and the elastic holder 4 is easier to insert into the housing 2. When the front end of the inner ring member 7 contacts the driver housing portion 41 and the rear end of the inner ring member 7 contacts the blocking portion 436, the insertion pressure applied to the blocking portion 436 can be transmitted directly to the driver housing portion 41.

A groove portion 21*a* extending around the entire circumference is formed as an engaging portion in the inner peripheral face of the main portion 21 of the housing 2, and the claw portions 721-723 formed in the ring-shaped portion 72 of the inner ring member 7 engage the groove portion 21*a*. By inserting the inner ring member 7 into the main body 21 of the housing 2 while being elastically deformed inward in the radial direction, the inner ring member 7 applies restoring force outward in the radial direction. This more securely engages the claw portions 721-723 in the groove portion 21*a*. By elastically deforming the semi-cylindrical portion 432 attached to the inner ring member 7 in a similar manner, the elastic restoring force of the semi-cylindrical portion 432 can be added to the elastic restoring force of the inner ring member 7. By using the inner ring member 7 to secure the elastic holder 4 in the housing 2, the amount of adhesive applied between the housing 2 and the elastic holder 4 can be reduced or eliminated.

Figure 5A:
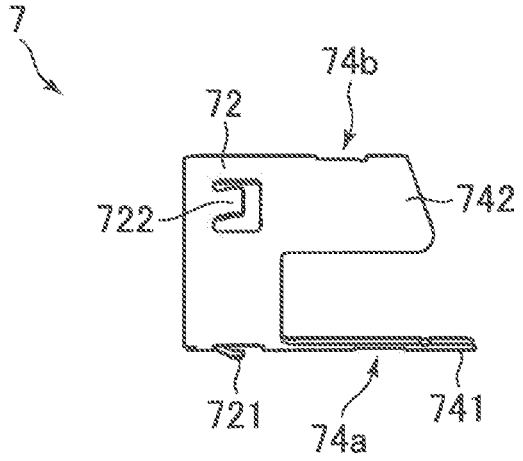
FIG. 5A is a side view of an inner ring member included in the earphone of FIG. 1.
Figure 5B:
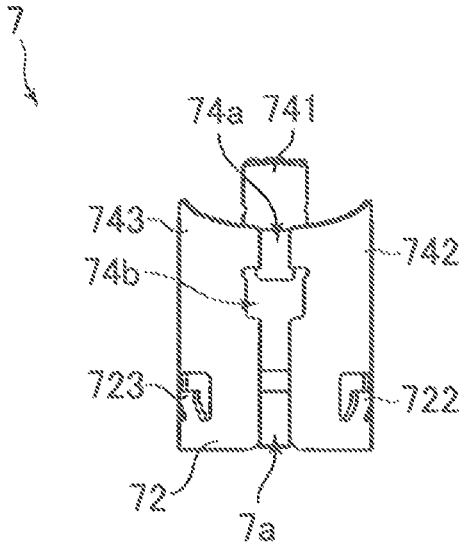
FIG. 5B is a top view of the inner ring member of FIG. 5A.
Figure 5C:
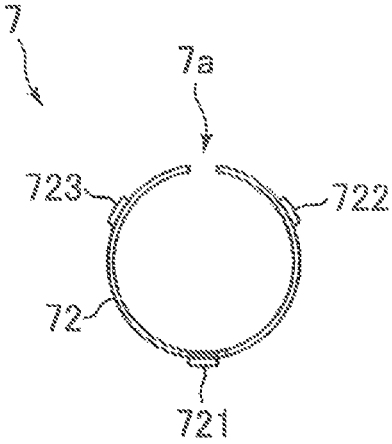
FIG. 5C is a front view of the inner ring member of FIG. 5A.
Figure 5D:
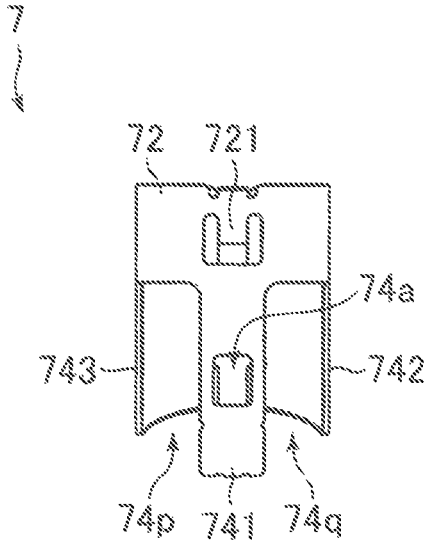
FIG. 5D is a bottom view of the inner ring member of FIG. 5A.

The extended portion 434 of the cord housing portion 43 is inserted into one of the two cutouts 74*p*, 74*q* formed to the left and the right of the bottom extended portion 741 of the inner ring member 7 (see FIG. 5D). By forming two cutouts 74*p*, 74*q*, the inner ring member 7 can be applied to an elastic holder 4 for either ear.

The inner ring member 7 explained above is not essential to the configuration of the present embodiment. The elastic holder 4 can be inserted into the housing 2 and secured using an adhesive instead of the inner ring member 7. This has the same effect as attaching an inner ring member 7, and further reduces the number of components.

Figure 6:
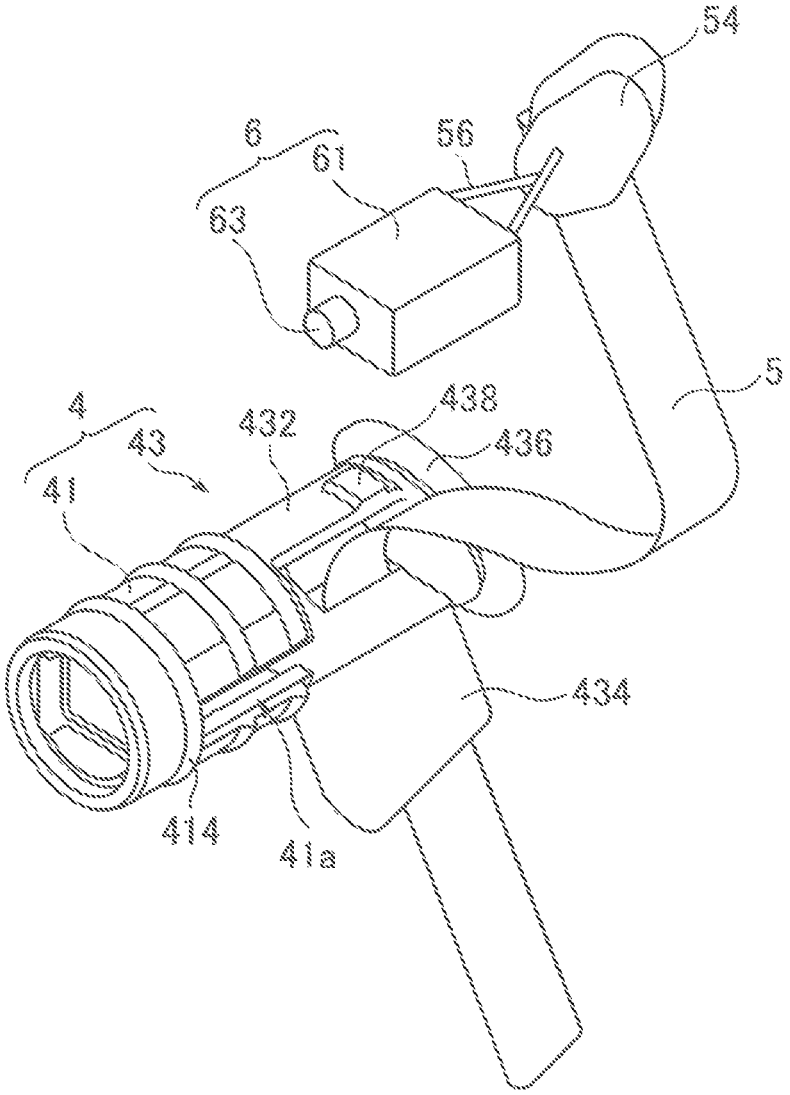
FIG. 6 is a diagram used to explain the manufacturing process for the earphone of FIG. 1.

FIGS. 6-7 are diagrams used to explain the manufacturing process for the earphone 1. First, the cord 5 is passed upward into the cord insertion hole in the extended portion 434 of the elastic holder 4, and then pulled out from the semi-cylindrical portion 432. Next, a knob-shaped end portion 54 is formed in the upper end of the cord 5. Next, the electrical wires 56 extending from the end portion 54 are soldered to terminals (not shown) provided in the rear face of the driver 6. The result is the configuration shown in FIG. 6. Next, the cord 5 is pulled downward so the end portion 54 is housed inside the semi-cylindrical portion 432, and the driver 6 is inserted from the outside to the inside via the slit 41*a* formed in the driver housing portion 41. Next, the inner ring member 7 is attached to the semi-cylindrical portion 432. The result is the configuration shown in FIG. 7.

As explained above, an assembly 10 is formed which includes the elastic holder 4, the cord 5, the driver 6, and the inner ring member 7. Afterwards, the assembly 10 is inserted into the main body 21 of the housing 2, and the earpiece 3 is attached to complete the earphone 1.

Because the cord 5 is connected to the driver 6 using this assembly 10, the driver 6 can be tested for faults before the earphone 1 is completed. Because the components in the assembly 10 can be visually inspected before the earphone 1 is completed, the operation can be simplified and variations among products and lots can be reduced. Because all of the internal components are housed inside the housing 2, this earphone 1 can be manufactured with very high productivity.

Figure 8:
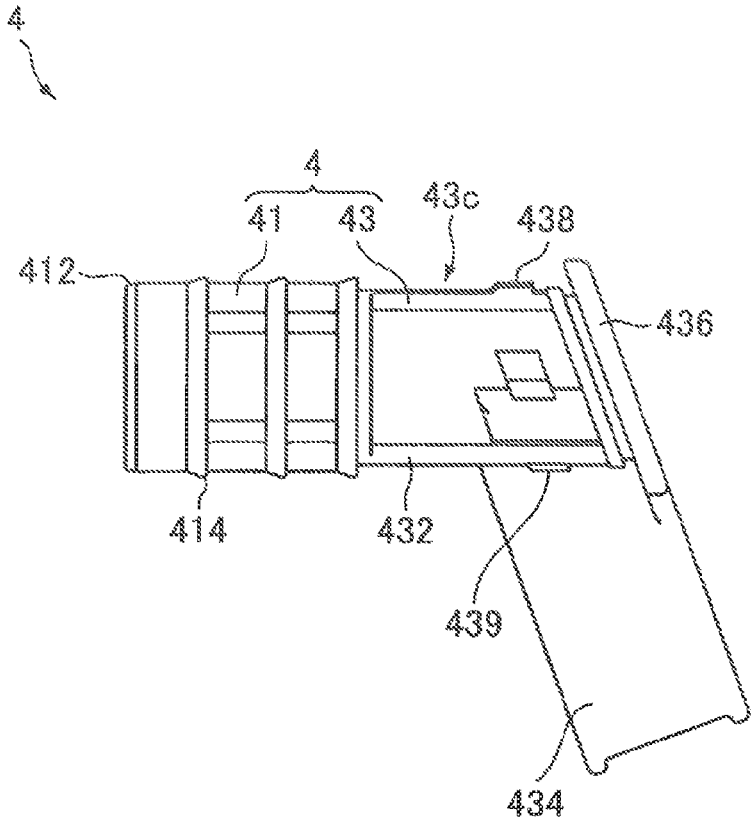
FIG. 8 is a side view of the elastic holder included in the earphone of FIG. 1.

An embodiment of the Present Disclosure, explained above, is not limited to this embodiment. Various modifications can be conceived by those skilled in the art. For example, in this embodiment explained above, a slit 41*a* was formed in the driver housing portion 41 of the elastic holder 4. However, as shown in FIG. 8, a slit 41*a* does not have to be formed in the driver housing portion 41. This makes the configuration more airtight than the embodiment described above. When the elastic holder 4 shown in FIG. 8 is used, the electrical wires 56 can be connected to the rear face of the driver 6 with the driver 6 inserted into the driver housing portion 41, the electrical wires 56 can be connected to the rear face of the driver 6 with the electrical wires 56 pulled out from the front of the driver housing portion 41, or the driver 6 with the electrical wires 56 connected can be pushed in through the opening 418*a* in the partitioning wall 418.

Further, in the present embodiment, the semi-cylindrical portion 434 of the cord housing portion 43 was provided on the right side of the elastic holder 4. However, the semi-cylindrical portion 434 of the cord housing portion 43 may be provided below the elastic holder 4, and the extended portion 436 can extend downward from the bottom end. Also, the profiles of the housing 2 and the elastic holder 4 were cylindrical, but the profiles can be cylindrical with a rectangular cross-section.

While a preferred embodiment of the Present Disclosure is shown and described, it is envisioned that those skilled in the art may devise various modifications without departing from the spirit and scope of the foregoing Description and the appended Claims.

What is claimed is:

1. An earphone, the earphone comprising:

a driver, the driver converting electric signals into sound waves;

a cord, the cord being connected to the driver;

an elastic holder, the elastic holder including a cylindrical driver housing portion and a cord housing portion, the driver being inserted into the driver housing portion, the cord housing portion housing an end portion of the cord, the cord housing portion including a wall portion and an extended portion, the wall portion being continuous with the driver housing portion, the extended portion extending from an outer face of the wall portion;

a housing, the housing including a cylindrical main body, the driver housing portion being inserted into the main body;

a sound conduit, the sound conduit disposed in an end portion of the main body; and an earpiece, the earpiece fitting into the ear canal for directing sound waves from the sound conduit to the ear canal.

2. The earphone of claim 1, wherein an insertion hole is formed from the wall portion to the extended portion, the insertion hole being formed for insertion of the cord.

3. The earphone of claim 1, wherein a ring-shaped end portion of the driver housing portion surrounds an opening in the sound conduit provided in the end portion of the main body.

4. The earphone of claim 1, wherein a rib is formed in an outer peripheral face of the driver housing portion, the rib extending peripherally to contact an inner peripheral face of the housing.

5. The earphone of claim 4, wherein a rib is formed in an inner peripheral face of the driver housing portion, the rib extending peripherally to contact an outer face of the driver.

6. The earphone of claim 5, wherein the rib on the outer peripheral face and the rib on the inner peripheral face are staggered with respect to each other in an axial direction of the driver housing portion.

7. The earphone of claim 1, wherein a slit is formed in the driver housing portion, the slit enabling the driver connected to the cord to be inserted from the outside of the driver housing portion to inside the driver housing portion.

8. The earphone of claim 1, further comprising an inner ring member, the inner ring member being attached to the cord housing portion and inserted between the cord housing portion and main body.

9. The earphone of claim 8, wherein the inner ring member includes an engaging portion, the engaging portion engaging a part of an inner peripheral face of the main body.

10. The earphone of claim 9, wherein the inner ring member further includes a ring-shaped portion, the ring-shaped portion being formed in the engaging portion and partially cutaway in a circumferential direction to enable elastic deformation in a radial direction.

11. The earphone of claim 10, wherein the cord housing portion further includes a blocking portion, the blocking portion blocking an opening in the main body.

12. The earphone of claim 11, wherein the inner ring member further includes an extended portion, the extended portion extending from the ring-shaped portion in an axial direction and contacting the blocking portion.

13. The earphone of claim 9, wherein the cord housing portion further includes a blocking portion, the blocking portion blocking an opening in the main body.

14. The earphone of claim 13, wherein the inner ring member fits into a recessed portion, the recessed portion formed between the driver housing portion and the blocking portion.

* * * * *